United States Patent [19]

Hansen, Jr. et al.

[11] 4,445,850

[45] May 1, 1984

[54] MACHINE FOR HEATING ELONGATED FLAT SURFACES

[76] Inventors: Axel E. Hansen, Jr., 5045 Lawnview St., Jacksonville, Fla. 32205; James C. Richardson, 5212 Damascus Rd., Jacksonville, Fla. 32207

[21] Appl. No.: 427,788

[22] Filed: Sep. 29, 1982

[51] Int. Cl.[3] ..... F24J 3/00

[52] U.S. Cl. ..... 432/229; 228/25; 228/28; 432/230

[58] Field of Search ..... 432/229, 230, 231, 232, 432/33; 228/25, 28

[56] References Cited

U.S. PATENT DOCUMENTS

| | | | |
|---|---|---|---|
| 3,397,423 | 8/1968 | Burch | 432/33 |
| 3,619,552 | 11/1971 | Cape | 228/28 |
| 3,857,690 | 12/1974 | Zappia | 432/231 |
| 3,930,790 | 1/1976 | Rogosch | 432/229 |
| 3,946,933 | 3/1976 | Bergling | 228/25 |
| 4,371,106 | 2/1983 | Chapman | 432/231 |
| 4,402,668 | 9/1983 | Cameron | 432/230 |

FOREIGN PATENT DOCUMENTS

| | | | |
|---|---|---|---|
| 52-31936 | 3/1977 | Japan | 228/28 |

*Primary Examiner*—Henry C. Yuen
*Attorney, Agent, or Firm*—Arthur G. Yeager

[57] ABSTRACT

A machine for heating elongated flat surfaces comprising an elongated supporting framework having on its upper portions peripheral ledges for supporting edges of an elongated flat plate to be heated, parallel tracks beneath said ledges running lengthwise of the framework, a wheeled carriage adapted to move in said tracks from one end of the framework to the other, heating means carried on the carriage to direct heat against the undereneath surface of the plate, and means for driving the carriage at a steady pace over the length of the tracks. This machine is useful in heating the underneath side of painted plates so that the paint may be stripped therefrom and the plates used again.

14 Claims, 8 Drawing Figures

MACHINE FOR HEATING ELONGATED FLAT SURFACES

BACKGROUND OF THE INVENTION

In the advertising industry there are many types of signs such as billboards that are employed to promote products, organizations, persons, etc. The signs are frequently owned by one organization and are leased for brief periods of time for each promotional object. In many instances the promotional information is painted on the sign which is a thin metal plate of aluminum, steel or the like. At the end of the leasing, or whenever repeated painting causes on undesirable buildup with increased cracking or flaking, the paint must be removed from the sign and made available for another promotional purpose. Paint is somewhat difficult to remove from a metal surface and this is particularly so in the instance of the large area surfaces involved in billboards. It is an object of this invention to provide a means for removing such paint from large panel sections of billboards by removing such sections and placing them in a machine which can then heat this surface causing the paint to be easily scraped off and the sign made ready for reuse. Other objects will be apparent from the more detailed description of this invention which follows.

BRIEF DESCRIPTION OF THE INVENTION

This invention provides a machine for heating elongated flat surfaces, such as panels of billboards, comprising an elongated supporting framework having on its upper portion peripheral ledges for supporting the edges of an elongated flat plate to be heated, parallel guideways or tracks beneath said peripheral ledges running lengthwise of said framework. A wheeled carriage moves in such tracks from one end of the framework to the other, heating means is carried on the carriage to direct heat against the underneath surface of the plate, and driving means are connected to the carriage to move it at a steady pace along said tracks. In a specific embodiment of this invention the heating means comprises a plurality of gas burners with their flames directed upwardly against the underneath side of the plate, and the driving means comprises a motor driven chain attached to the carriage. In another specific embodiment of this invention the machine includes limit switches located at both ends of the track to be contacted by the carriage and cause the driving means to cease further movement in that direction, and preferably to reverse the movement to the opposite direction.

BRIEF DESCRIPTION OF THE DRAWINGS

The novel features believed to be characteristic of this invention are set forth with particularity in the appended claims. The invention, itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
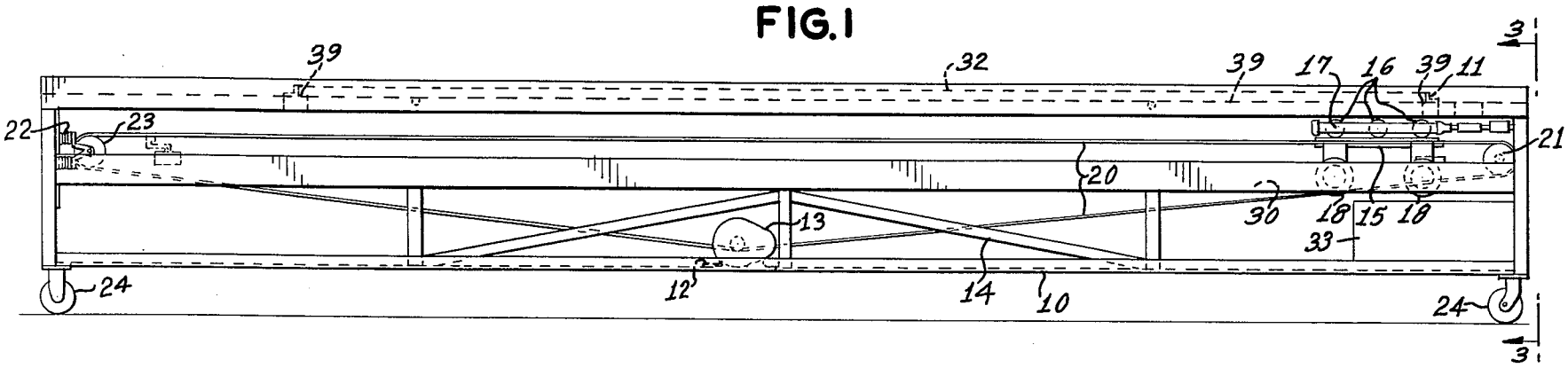
FIG. 1 is a front elevational view of the machine of this invention.
Figure 2:
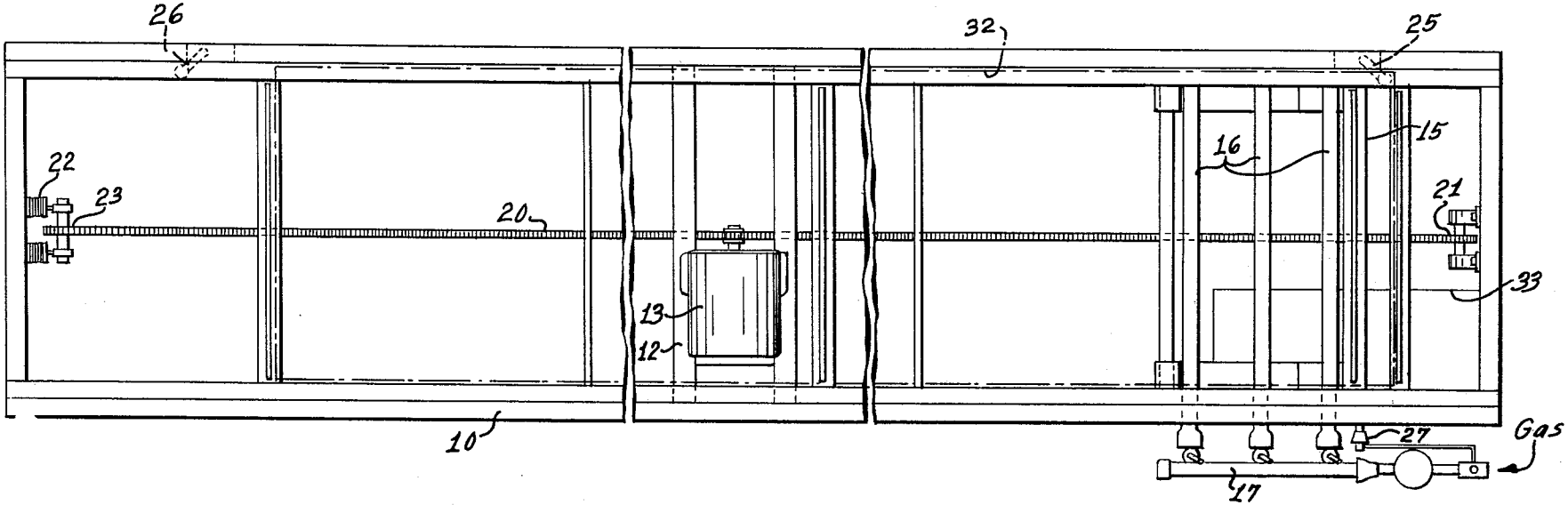
FIG. 2 is a top plan view of the machine of this invention.

The general features of the machine of this invention can be readily understood by reference to the drawings of FIGS. 1 and 2. A rectangular framework 10 forms the structure that houses the entire machine. In general this framework is prepared from structural sections of steel such as angles, channels, strips, and beams. Framework 10 is made in whatever size is needed to receive a panel from a billboard on its upper surfaces and preferably is made movable by mounting on casters 24. These panels may be 12–16 feet in length and 2–4 feet in width. Accordingly, the component parts of framework 10 must be of sufficiently heavy structural steel to be rigid and will normally include diagonal stiffening members, such as that shown at 14. Panel 32 which is to be heated, is placed flat on the upper portion of framework 10 resting on ledges 40 around the periphery of the upper portion of the framework. These ledges 40 may be formed by employing the two lengthwise beams along the sides of the framework and placing two crosswise angles 11 at an appropriate place to provide a good seating recess to receive panel 32. Panel 32 is placed with its painted side uppermost and its unpainted surface facing downward so that heat may be applied to the lower surface and the blistering paint caused by the heating can be scraped off of the upper surface.

A movable carriage 15 rides on wheels 18 along lengthwise tracks 30 from one end of framework 10 to the other carrying gas burners 16 which direct gas flames against the underneath side of panel 32. Carriage 15 is driven by any suitable means which will move the carriage at a steady pace from one end of framework 10 to the other. The means shown in these drawings comprises a motor 13 mounted on a motor support 12 in the lower central portion of framework 10 and driving a long chain 20 around front sprocket 21 and rear sprocket 22. Chain 20 is attached firmly to carriage 15 causing the carriage to move as chain 20 moves. In order to prevent carriage 15 from moving too far in either direction there are limit switches 25 and 26 mounted on framework 10 to contact the edge of carriage 15, and when this happens, power to chain 20 is interrupted and the movement of chain 20 and of carriage 15 stops. It is preferred that not only does rear limit switch 25 and forward limit switch 26 stop the movement of chain 20 but that they also reverse the direction of chain 20 by reason of suitable electrical connection for motor 13.

Figure 3:
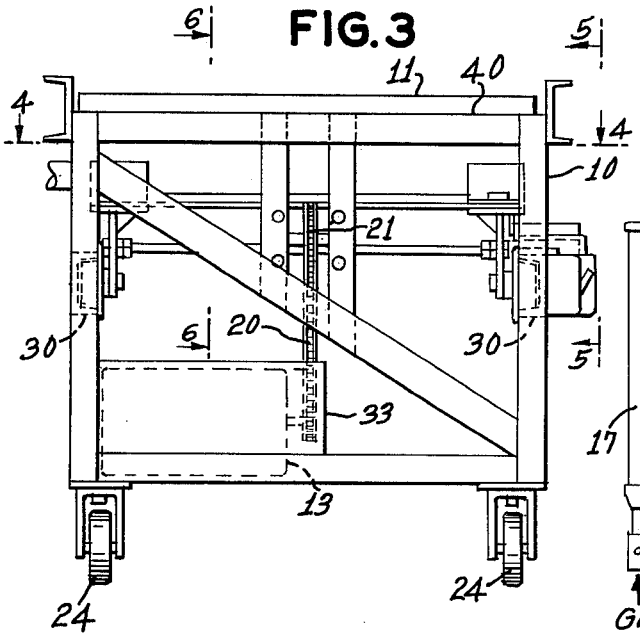
FIG. 3 is an end elevational view taken in the direction of 3—3 of FIG. 1.
Figure 4:
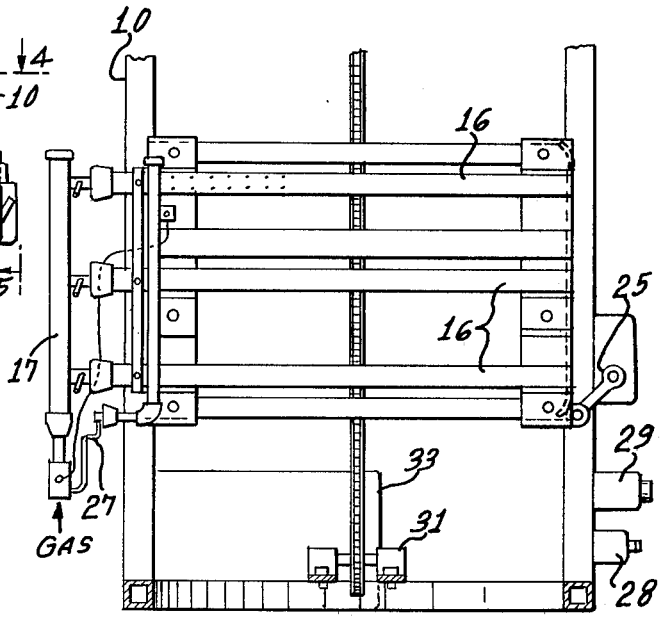
FIG. 4 is a cross sectional view taken in the direction of 4—4 of FIG. 3.

In FIGS. 3–7 some of the detailed portions of the components of this machine may be better understood. In FIGS. 3 and 4 it may be seen that the burners 16 are mounted so as to extend completely across the lateral width of the machine so as to apply heat to the entire lateral width of panel 32 lying above. The gas burner assembly includes a header 17 and a pilot light system 27. Since the burner is on a moving carriage it is necessary that the main gas supply be attached to header 17 by means of some type of flexible tubing which will permit an unrestricted movement of carriage 15. Track 30 is shown as a channel beam of a suitable size for receiving wheels 18. This channel beam 30 also serves as a structural member since it inherently has good strength properties. Control box 33 is shown as a housing for the various electric controls, switches, and relays needed for the operation of the machine. Limit switch 25 is shown contacting the edge of carriage 15. There is also shown a main power switch 28 and a start button 29 employed to start the movement of carriage 15 from one end to the other of the machine.

Figure 5:
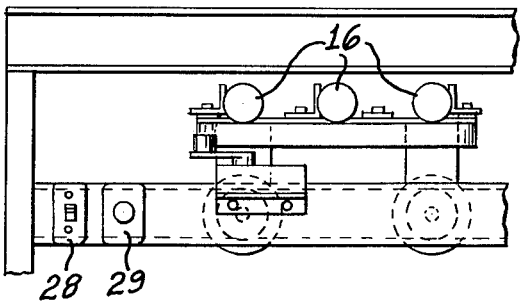
FIG. 5 is a partial side elevational view of the portion shown at 5—5 of FIG. 3.
Figure 7:
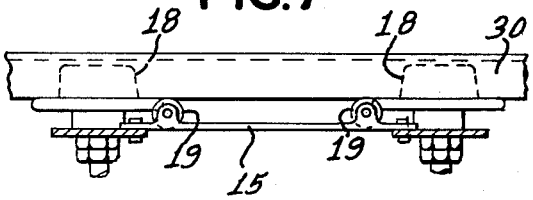
FIG. 7 is a partial cross sectional view taken at section 7—7 of FIG. 6.
Figure 6:
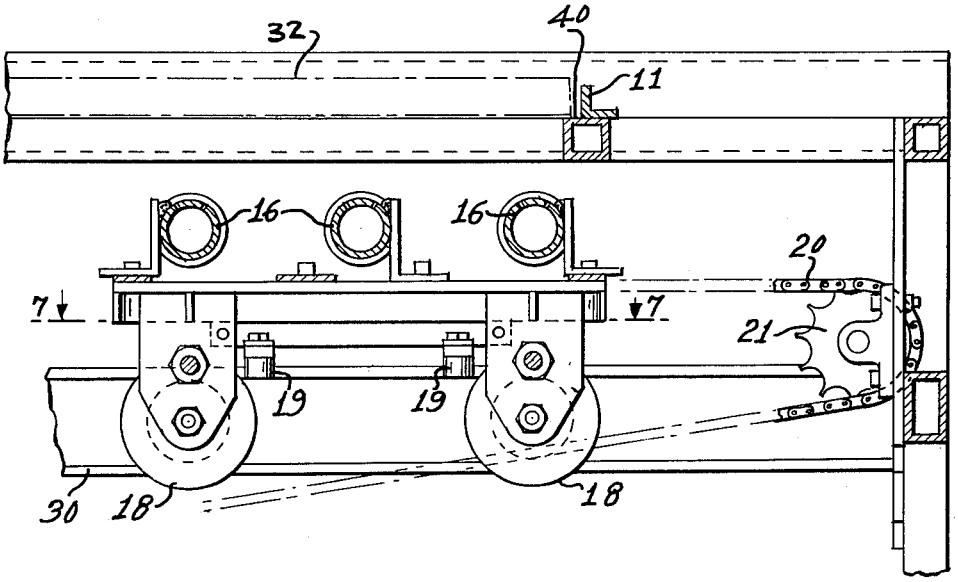
FIG. 6 is a partial cross sectional view taken at section 6—6 of FIG. 3.

Other details of the carriage and portions of the machine of this invention may be seen in FIGS. 5–7. In order to stabilize the movement of carriage 15 it is preferred that there be placed on the two lateral sides of carriage 15 two or more small rollers 19 which guide and control the lateral movement of the carriage during its travel. It may also be seen that front sprocket 21 is mounted on a shaft which is carried in a pillow block bearing attached to the framework 10. At the rear end of the machine sprocket 23 is attached to framework 10 by spring mountings 22 which serve to provide the necessary tensioning of chain 20 for proper operation.

Figure 8:
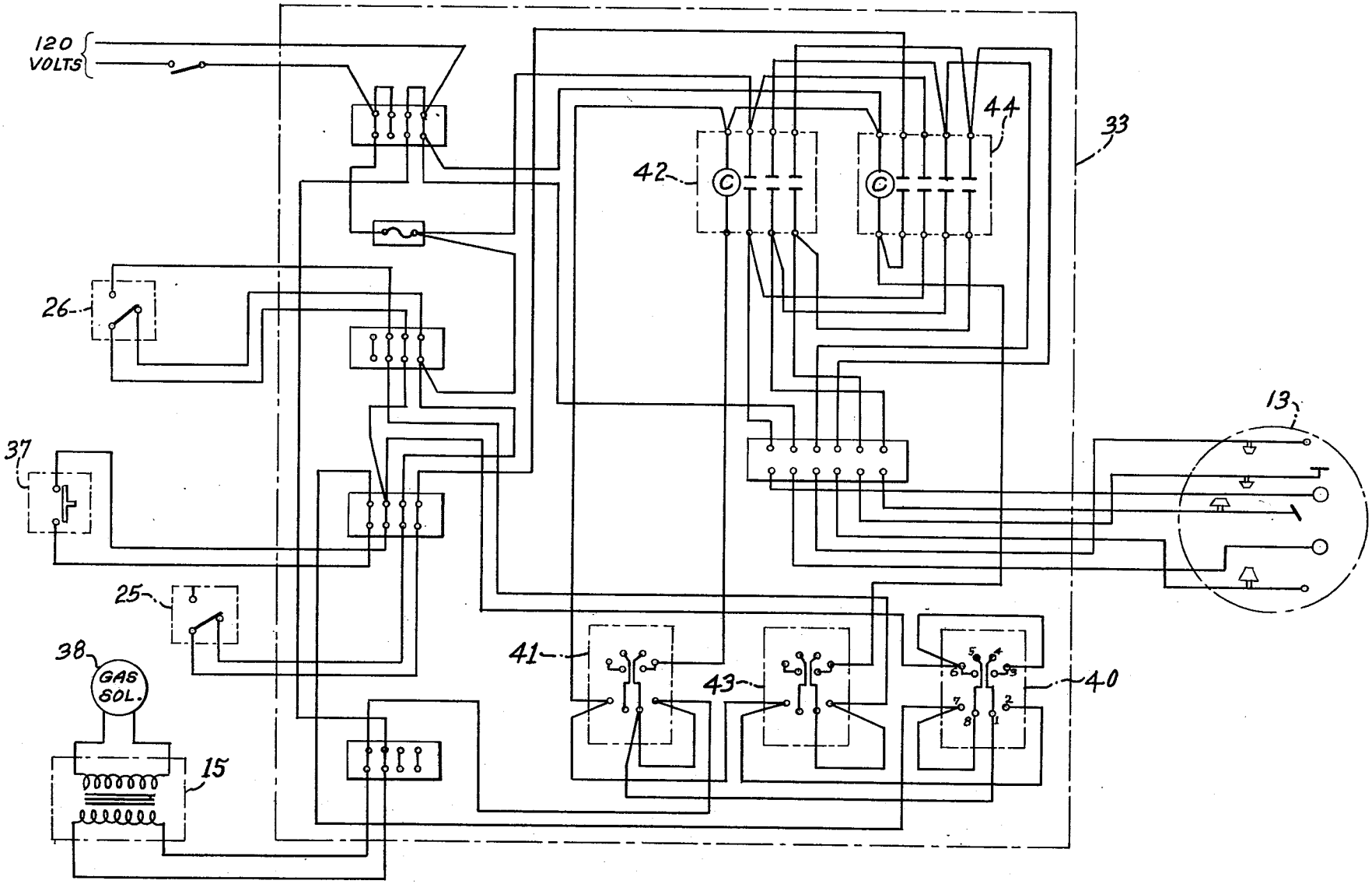
FIG. 8 is an electric circuit diagram of the machine of this invention.

In FIG. 8 there is shown the electric circuitry for the operation of the machine of this invention. When the start button 37 is pushed the contacts of the gas relay 40 which are normally open will close. This energizes gas solenoid 38. The gas solenoid opens and the gas burner 16 is ignited. At the same time, through gas relay 40 control power is applied to forward time delay relay 41 which is set for approximately 15 seconds. When normally open contacts of forward relay 41 close it energizes the forward motor contactor 42, which closes causing motor 13, chain 20, and carriage 15 to run forward.

When carriage 15 reaches the end of the run it activates the forward limit switch 26 opening the normally closed contacts and closing the normally opened contacts. Opening the normally closed contacts breaks the circuit to gas relay 40. The gas relay's normally open contacts will then open and gas burner 16 will turn off. Also the contacts of forward time delay relay 41 will open, breaking the circuit to the forward motor contactor 42 causing it to open. The motor, chain, and carriage will then stop.

The normally open contact of limit switch 36 energizes the reverse time delay relay 43 which is set for approximately 7 seconds. When the reverse time delay relay's normally open contact closes it energizes the reverse motor contactor 44 which in turn closes and causes motor 13, chain 20, and carriage 15 to run in reverse.

When the carriage 15 reaches the end of the run it activates the reverse limit switch 25. The normally closed contacts of switch 25 open causing reverse motor contactor 44 to open and the motor, chain, and carriage will stop.

The electrical components 40,41,42,43, and 44, and associated wiring are housed in control box 33. Gas solenoid 38 is mounted on carriage 15.

While the invention has been described with respect to certain specific embodiments, it will be appreciated that many modifications and changes may be made by the most skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A machine for heating elongated flat surfaces comprising an elongated supporting framework having on its upper portion peripheral ledges for supporting the edges of an elongated flat plate to be heated, parallel tracks beneath said peripheral ledges running lengthwise of said framework, a wheeled carriage adapted to move in said tracks from one end of said framework to the other, heating means carried on said carriage to direct heat against the underneath surface of said plate, and driving means to move said carriage at a steady pace along said tracks.

2. The machine of claim 1 wherein said heating means comprises a gas burner.

3. The machine of claim 1 wherein said driving means comprises an electric motor and a chain driven by said motor.

4. The machine of claim 1 having a limit switch adjacent each end of said tracks and adapted to be contacted by said carriage and to interrupt the power to said carriage.

5. The machine of claim 4 wherein said switch reverses the direction of drive of said motor.

6. A machine for heating an elongated flat metal plate comprising an elongated rectangular framework having on its upper portion peripheral ledges for supporting said plate around its edges in a generally horizontal position, a wheeled carriage movable in tracks beneath said ledges and carrying gas burners directed upwardly against the lower surface of said plate, the movement of said carriage from one end to the other end of said tracks adapted to heat substantially the entire lower surface of said plate, driving means to move said carriage along said tracks, and means for controlling the delivery and burning of gas in said burners.

7. The machine of claim 6 including a limit switch at each end of said tracks to be contacted by said carriage and to stop the movement of said carriage in that direction.

8. The machine of claim 7 wherein said switch reverses the direction of movement of said driving means.

9. The machine of claim 6 wherein said driving means comprises a motor driven chain attached to said carriage.

10. The machine of claim 6 wherein said carriage comprises two axles each supporting two wheels which ride in two-tracks running lengthwise of said framework and said carriage carrying a plurality of upwardly directed gas burners extending substantially completely across the lateral extent of said carriage.

11. The machine of claim 10 which includes two guide wheels carried on each side of said carriage to control lateral movement of said carriage.

12. The machine of claim 6 which includes automatic means for feeding gas to said burners and lighting said gas.

13. A machine for heating an elongated flat metal plate comprising an elongated rectangular framework having on its upper surface peripheral ledges on four sides adapted to support a flat panel around its edges in a generally horizontal position, a four-wheeled carriage movable in horizontal tracks from one end to the other of said framework underneath said ledges and carrying a plurality of gas burners directed upwardly against the underneath surface of said panel each burner extending across the lateral width of said panel, a motor driven chain attached to said carriage for driving said carriage from one end to the other of said tracks, guide wheels on the lateral sides of said carriage bearing against said framework to restrict lateral movement of said carriage, and limit switches at each end of said tracks to contact said carriage and thereupon to stop the movement of said chain and to turn off the gas being fed to said burners.

14. The machine of claim 13 which includes a timing means to reverse the direction of said chain a selected period of time after the carriage contacts said limit switch.

* * * * *